United States Patent [19]

Wolar

[11] 4,403,214

[45] Sep. 6, 1983

[54] PROTECTIVE DEVICE FOR ATTACHMENTS AFFIXED TO ELECTRICALLY OPERATED BEDS

[76] Inventor: William Wolar, 59 Fremont Rd., North Tarrytown, N.Y. 10591

[21] Appl. No.: 309,591

[22] Filed: Oct. 8, 1981

Related U.S. Application Data

[63] Continuation-in-part of Ser. No. 200,990, Oct. 27, 1980, Pat. No. 4,325,062.

[51] Int. Cl.[3] ..... G08B 21/00

[52] U.S. Cl. ..... 340/540; 5/424; 200/61.43; 340/679

[58] Field of Search ..... 340/679, 665, 686, 540; 5/63, 424, 508; 200/61.43

[56] References Cited

U.S. PATENT DOCUMENTS 3,774,149 11/1973 Bennett ..... 340/686

*Primary Examiner*—Glen R. Swann, III

*Attorney, Agent, or Firm*—Eugene E. Geoffrey, Jr.

[57] ABSTRACT

The protective device includes a switch, a spring loaded switch actuator overlying and coextensive with the upper surface of the attachment supported by the bed, an electric control interconnected with the power supply to the bed and said switch so that elevation of said bed is automatically terminated upon contact of said switch actuator with an obstacle above the bed. The protective device may also be integrated with the attachment support in that the support includes the switch and a spring supporting the attachment in an upper position so that the attachment upon engaging an obstacle will be depressed and actuate the switch to interrupt elevation of the bed.

10 Claims, 18 Drawing Figures

PROTECTIVE DEVICE FOR ATTACHMENTS AFFIXED TO ELECTRICALLY OPERATED BEDS

CROSS-REFERENCE TO A RELATED APPLICATION

This application is a continuation-in-part of Application Ser. No. 200,990, filed Oct. 27, 1980 entitled "Protective Means for Attachments Affixed to Electrically Operated Beds", now U.S. Pat. No. 4,325,061, issued Apr. 13, 1982.

BACKGROUND OF THE INVENTION

This invention relates to protective means for use with electrically operated beds of the type employed in hospitals, nursing homes and the like and more specifically to means for use with bed attachments such as infusion standards, and other devices, which generally extend above the head of the bed, to limit upward motion of the bed in the event the attachment carried thereby engages another object such as a wall lighting fixture, shelf, supply pipes for liquids and gases and the like.

OBJECTS OF THE INVENTION

It is frequent, particularly in hospitals, that infusion standards as well as trapeze-like structures are affixed to beds for use by patients and are elevated and lowered with the bed. In as much as lighting fixtures and other structures often project from the wall above or adjoining the bed, attachments extending above the bed can strike such structures and cause not only considerable material damage to equipment but also serious injury to a patient. This invention overcomes this difficulty and provides a novel and improved structure that will automatically terminate upward motion of the bed immediately upon contact with any obstruction above the bed.

Another object of the invention resides in the provision of novel and improved protective means for use with attachments affixed to electrically operated beds to interrupt upward motion of the bed in the event the attachment contacts an obstruction of any kind.

SUMMARY OF THE INVENTION

The invention is applicable for use with a great variety of attachments adapted to be secured to the head portion of an electrically operated bed and in one form includes normally open switch means carried by the attachment, switch actuating means positioned on the attachment in such a manner that the actuating means will engage a wall obstruction in advance of the attachment, relay means interconnected with the power supply to the bed and operable upon actuation of the switch to interrupt the power and thus terminate continued elevation of the bed. In another form, the attachment support includes the switch means and the attachment is maintained in an upper position in the support by spring means. Then should the attachment contact a wall obstacle by reason of the elevation of the bed, it will be depressed and actuate the switch to interrupt further elevation of the bed.

The above and other objects and advantages of the invention will become more apparent from the following description and accompanying drawings forming part of this application.

IN THE DRAWINGS

DETAILED DESCRIPTION

Considerable difficulty has heretofore been encountered with the attachment of infusion standards and other mechanical structures to beds such as hospital beds for the treatment and convenience of patients. The principal difficulty involves the interference of a bed attachment with a light fixture or other wall obstruction as the bed is raised. With light fixtures, severe damage results not only to the light fixture and the attachment but even more important the patient may be seriously injured. Heretofore, light fixtures have been designed which tilt upwardly upon engagement with a bed attachment or in the alternative are placed high enough above the bed to avoid any possibility of such engagement. In the latter case, however, the light fixture is often much too high to be of real value to the patient. Other wall obstructions such as outlets for oxygen, air, liquid and the like and electrical boxes may also be positioned on the wall above or adjoining the bed and severe damage can occur should a standard or other device affixed to the bed engage such outlets or electrical devices.

This invention overcomes the foregoing difficulties and provides means on or associated with an infusion standard or other attachment, which upon engagement of any wall obstruction as the bed is being raised, will automatically terminate the operation of the bed and thus avoid damage to either the wall obstruction or the attachment affixed to the bed and protect the patient from possible injury.

Figure 1:
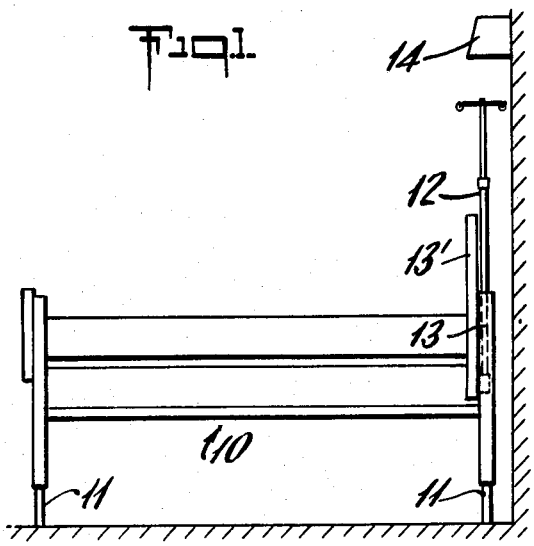
FIG. 1 is a side elevational view of a conventional hospital bed with an infusion standard or so-called IV pole affixed to the head of the bed.
Figure 2:
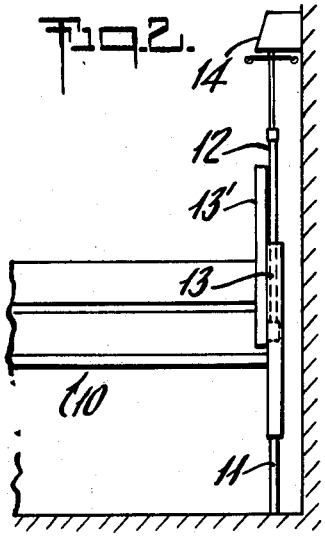
FIG. 2 is a side elevation of a fragmentary portion of the bed shown in FIG. 1 but in raised position and showing the infusion standard engaging an obstruction such as a light fixture on the wall when the bed is raised.

Referring now to the drawings and more specifically to FIGS. 1 and 2, an adjustable bed such as a hospital bed, denoted in these figures by the numeral 10, includes among other features elevating means which may be in the form of telescoping legs 11 operated by an electric motor not illustrated. Elevating means are well known in the art and accordingly a detailed description is not deemed necessary. In the treatment of a patient, a transfusion standard for instance, such as the standard 12, is often affixed to the frame portion 13 forming part of the head of the bed and is designed to hold inverted bottles for intravenous transfusion. Should the bed be raised as illustrated in FIG. 2 when an infusion standard 12 is in place thereon, the standard can engage a wall obstruction such as the lighting fixture 14 or other equipment which may be mounted on the wall adjoining the head of the bed with the result that damage may not only occur to the wall obstruction and the standard but a patient can be seriously injured. To avoid this difficulty, this invention provides a novel and improved protective means, one form of which is illustrated in FIGS. 3 through 6 and 9.

Referring to FIGS. 3 through 6 illustrating an infusion standard in accordance with the invention, the standard is generally denoted by the numeral 15 and includes telescoping sections 16 and 17 with the section 16 carrying a compression fitting generally denoted by the numeral 18 in order to adjust the height of the standard. The lower end of the standard section 16 includes a collar 19 threadably engaging the bottom end of the standard section 16 and an elongated pin 20 extending below the collar 19. This pin engages an opening 21 in the bracket 22 (see FIG. 6) which is affixed to the bed frame portion 13. If desired, the bracket 22 can be fabricated in the form of a clamp having screws 22 to securely affix the infusion standard thereto.

The upper end of the infusion standard 17, in accordance with one embodiment of the invention, includes a housing generally denoted by the numeral 24 and consists of a tubular portion 25 affixed to the infusion standard section 17 by means such as the screw 26 and an upper tubular portion 27. A transverse rod 28 having hook-like portions 29 is affixed to the housing 27 by a weld 30 or other suitable means. The hook-like portions 29 are designed to hold transfusion containers in the usual manner. The housing section 27 further includes a push-button switch 31 affixed within an opening 32 in the upper end of the housing portion 27 by means of a threaded collar 33 and cooperating nut 34. The push-button 35 extends upwardly and upon depression actuates the switch 31.

The switch 31 is operated by an actuating bar 36 affixed to the transverse rod 28 by elongated pins 37 extending through cooperating openings in the bar 36 and rod 28. Springs 38 surround each pin 37 and bear against the bar 36 and washers 39 carried by the pins and adjoining the rod 28. The springs 38 maintain the bar 36 in an upper position and in the instant embodiment of the invention the switch 31 is in a normally open position.

With the foregoing arrangement and with the infusion standard 15 affixed to a hospital bed or the like, as the bed is raised and the infusion standard encounters an obstruction, the actuating bar 36 will be depressed and function to close the switch 31 before any damage occurs. As will be described, closure of the switch 31 automatically interrupts power to the bed and immediately prevents further elevation thereof.

Figure 3:
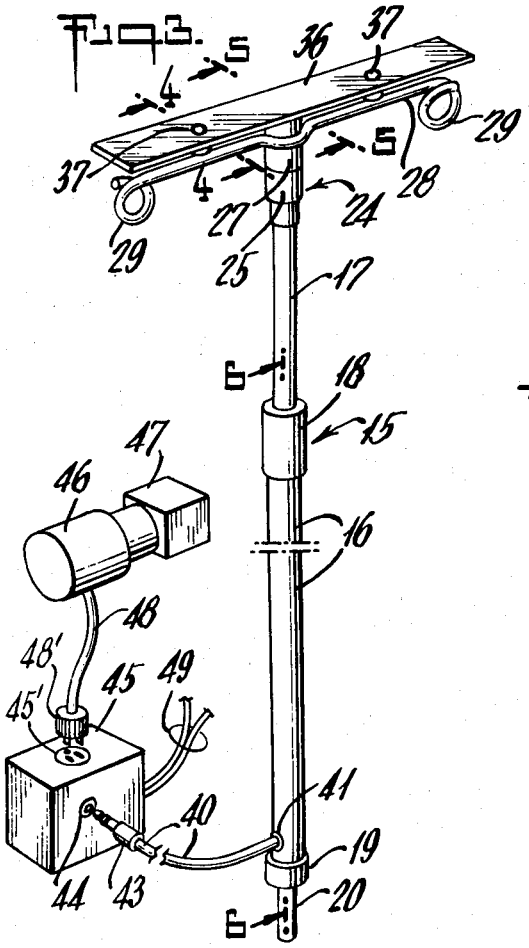
FIG. 3 is a perspective view of an infusion standard in accordance with the invention and interconnected with an electric motor utilized to raise and lower a bed such as that illustrated in FIGS. 1 and 2.
Figure 4:
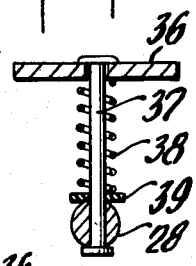
FIG. 4 is a cross sectional view of FIG. 3 taken along the line 4—4 thereof.
Figure 5:
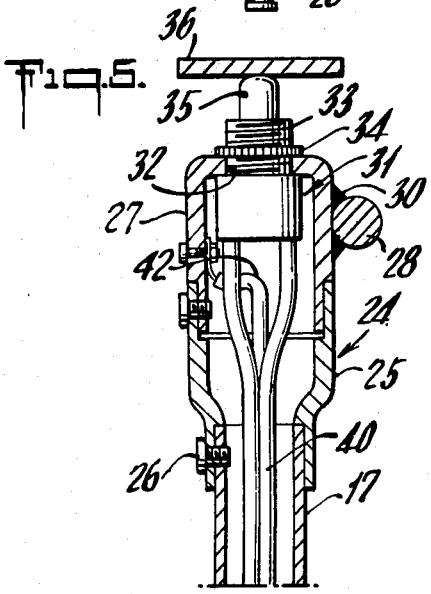
FIG. 5 is a cross sectional view of FIG. 3 taken along the line 5—5 thereof.
Figure 6:
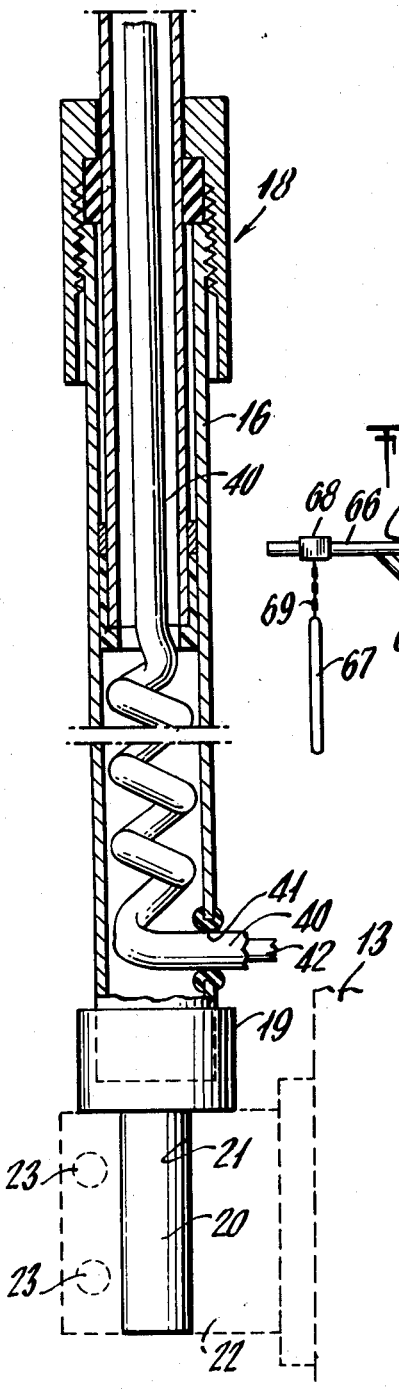
FIG. 6 is an enlarged cross sectional view of FIG. 3 taken along the line 6—6 thereof and illustrating diagrammatically the bracket means affixed to a bed for support of the infusion standard.

Interconnection of the switch 31 with the bed elevating motor is accomplished by a coiled control cable 40 connected to the switch 31, as illustrated in FIG. 5 and extending through the telescoping sections 16 and 17 of the standard and emerging through an opening 41 at the bottom of the standard section 16 as illustrated more clearly in FIGS. 3 and 6. The cable 40 may also include a ground lead 42 grounded to the housing portion 27 by a nut and bolt or other suitable means. The cable 40 together with the ground lead 42 is connected to a three circuit plug 43 as illustrated in FIG. 3 for connection to a receptacle 44 mounted on a control box 45. The bed operating motor 46, having a cooperating gear box 47, is connected via the lead 48 to a plug 48' for engaging a receptacle 45' on the control box 45, and power for operation of the motor and control means is provided by the power supply cable 49. The circuitry disposed within the box 45 for operation of a motor 46 is illustrated in FIG. 9.

Figure 9:
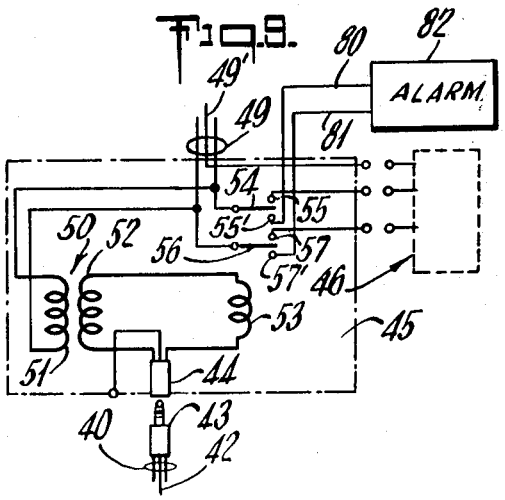
FIG. 9 is one embodiment of a circuit diagram illustrating one mode of interrupting the elevation of a bed in the event an infusion standard or other structural element on the bed engages an obstacle on the wall.

Referring to FIG. 9, the control box 45 includes a transformer 50 having a high voltage primary 51 connected to the incoming power line 49 and a low voltage secondary 52 producing 6 to 24 volts as may be desired. The transformer 50 is connected to the coil 53 of a relay having normally closed contacts 54–55 and 56–57. The receptacle 44 is connected to series with one side of the relay coil 53 so that in the absence of the plug 43 in the receptacle 44, the relay coil 53 will remain de-energized and the contact pairs 54–55 and 56–57 will be in a closed position. With this condition, power will be fed from the power line 49, having a ground lead 49', through the contact pairs to the motor 46 which operates the bed. The ground lead 49' is connected to the control box housing and to the housing of the motor 46. Accordingly, the standard control for the bed can be operated to raise and lower the bed. When the plug 43 is in engagement with the receptacle 44 and the switch 31 is actuated because of engagement of the bar 36 with a wall obstruction, the circuit to the relay coil 53 is closed and the contact pairs 54–55 and 56–57 are opened, interrupting the supply of energy to the motor 46 and thereby terminating further elevation of the bed. The height of the actuating bar 36 above the rod 28 of the infusion standard is adjusted so that the switch 31 is actuated when any portion of the bar contacts an obstruction. In this way, elevation of the bed is terminated prior to complete compression of the springs 38.

Figure 7:
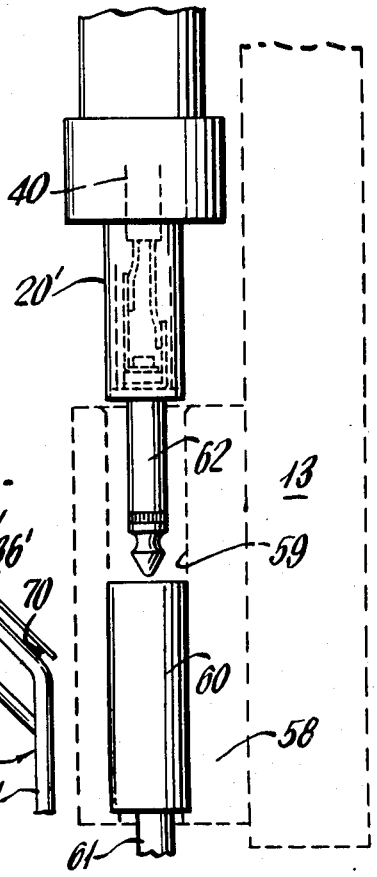
FIG. 7 is a fragmentary side elevational view of a modified form of an infusion standard in accordance with the invention together with a receptacle affixed to the bed for supporting the standard.

A modified form of the invention is illustrated in FIG. 7 and provides means for automatically connecting the switch 31 to the controlling means 45 when the infusion standard is affixed to the bed frame 13. In this form of the invention, the bracket affixed to the bed frame and denoted by the numeral 58 has an elongated opening 59 extending therethrough. The lower portion of the opening 59 includes a socket 60 having a control cable 61 extending from the bottom thereof. The post or pin 20 extending from the bottom of the infusion standard section 16 and denoted by the numeral 20' has an electrical plug 62 extending from the bottom thereof. This plug is connected to the control cable 40 within the standard. While the illustrated plug merely has two control contacts, it is well known that such plugs may include a third contact for the purpose of carrying the ground from the switch 31 and standard 15 to the control box 45. A cable 61 may be connected to the receptacle 44 by means of a suitable plug which remains permanently in position on the receptacle or in the alternative the cable 61 can be wired directly to the transformer secondary 52 and relay coil 53 as illustrated. With this arrangement, when the infusion standard is placed in position on the bed frame 13 so that the post 20' engages the opening 59, the plug 62 will engage the socket 60 and automatically connect the switch 31 to the transformer secondary 52 and relay coil 53 as previously described. With this arrangement, actuation of the actuating bar 36 will function to open the relay as previously described.

Figure 8:
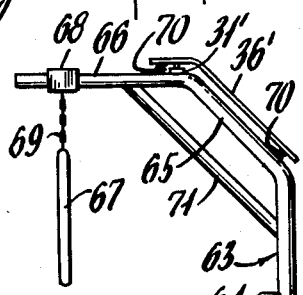
FIG. 8 is a fragmentary side elevational view of a trapeze-like structure adapted for attachment to the head of a bed to assist a patient in lifting himself for exercising and other purposes and embodying a protective device in accordance with the invention.

While the invention has thus far been described in connection with an infusion standard affixed to a bed having electrically operated elevating means, the invention is equally useful with other devices affixed to the head of the bed for a patient's treatment or convenience. One such structure is illustrated in FIG. 8 and is utilized to enable the patient to lift himself to a sitting position. It comprises a basic frame element 63 consisting of an upright position 64 secured either to the bed frame 13 or head board 13', a diagonal section 65 and a horizontal section 66 extending outwardly over the patient. A ring 67 is affixed to a bracket 68 by means of a chain 69 and the bracket 68 can be adjustably positioned on the horizontal frame portion 66. In order to interrupt elevation of the bed should the structure 63 engage a wall obstruction, a switch 31' similar to the switch 31 shown for instance in FIG. 5 may be mounted on the horizontal frame portion 66. An actuating bar 36' overlies the inclined frame portion 65 and at least part of the horizontal portion 66. The actuating bar is spring mounted on the frame elements 65 and 66 by means of spring 70 to function in substantially the same manner as the bar 36 illustrated in FIGS. 3 through 5. In the illustrated embodiment, a diagonal support 71 is provided on the frame 63.

With the structure as shown in FIG. 8, any contact between the actuating bar 36' and a wall obstruction will actuate the switch 31', which in turn is interconnected with the control 45 in the same manner as the switch 31, and thereby terminate elevation of the bed.

In the several illustrated embodiments of the invention, the relay 53 is normally de-energized and interruption of the bed elevating circuit is accomplished by energizing the relay as described. If desired, appropriate circuitry well within the skill of the art can be utilized so that the relay 53 would be in a normally energized position in order to enable the bed to be elevated in which case the switches 31 and 31' would be normally closed switches and would function to open the relay circuit upon actuation to interrupt continued elevation of a bed.

Another aspect of the invention resides in the provision of an audible and visual alarm 82 (see FIG. 9) which may be activated in the event a bed attachment engages an obstacle upon being elevated. In FIG. 9, it will be observed that a second set of contacts 55' and 57' are associated with the movable contactors 54 and 56 so that de-energization of the coil not only opens the contact pairs 54–55 and 56–57 but also closes the contact pairs 54–55' and 56–57' and applies energy to the leads 80 and 81, the latter being connected to an audible and/or visual alarm 82.

In certain applications, it may be desirable to avoid the need for a direct connection between the switches 31, 31' and the control box 45. In such instances, attachments such as 15 and 63 may be provided with conventional transmitters and the control box 45 may include a receiver which functions to de-energize the relay coil 53 upon either the presence or absence of a signal as the case may be. Since transmitters and receivers are well known in the art and are considered the equivalent of direct wire connections, a detailed illustration and description is not deemed necessary.

A modified form of the invention, illustrated in FIGS. 10 through 18, achieve the objectives of the form of the invention described in connection with FIGS. 1 through 7 and 9 but utilizes a switch disposed within the attachment support in place of the switch on the attachment itself. In this way, the attachment, such as an infusion standard, need not be modified to include an overlying switch actuating member and associated switch and depression of the standard upon contacting an obstacle will actuate a switch to interrupt elevation of the bed.

Figure 10:
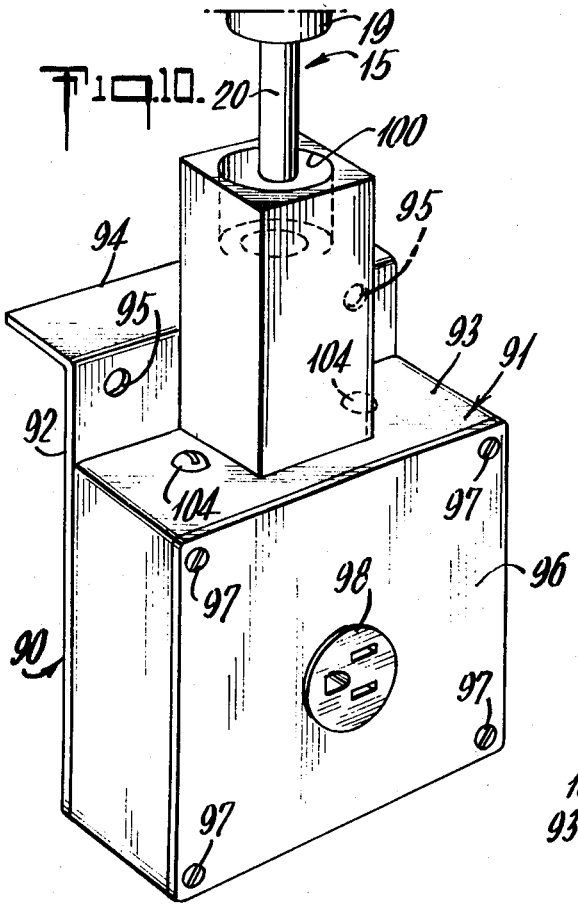
FIG. 10 is a perspective view of a modified embodiment of the invention.
Figure 11:
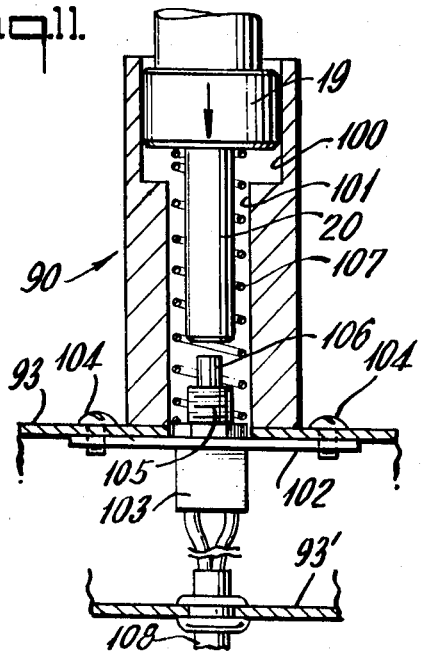
FIG. 11 is a cross sectional view of a fragmentary portion of FIG. 10 illustrating one form of attachment receiving means.

More specifically and with reference to FIGS. 10 and 11, the attachment support is generally denoted by the numeral 90 and includes a rectangular box 91 having a rear wall 92 which extends upwardly beyond the top wall 93 of the box 91 and may carry a rearwardly extending flange 94. That portion of the rear wall 92 extending above the box 91 may have a pair of openings 95 to receive screws or bolts for attaching the support 90 to a bed. The front wall 96 in the illustrated embodiment of the invention is affixed to the box 91 by screws 97 and in this embodiment of the invention includes a receptacle 98 which, as will be described, is for the purpose of supplying electrical energy to the electrically operated bed including the elevating means therefor.

The supporting means for an attachment such as an infusion standard 15 of conventional construction comprises an elongated column 99 which is affixed to the top wall 93 of the box 91 and the rear wall 92 of the box. The column 99 has a central bore 100 having a diameter that will slidably receive the collar 19 at the base of the infusion standard 15. The bore 100, as will be observed in FIG. 11, extends only a portion of the way into the column and a second bore 101 of somewhat smaller diameter extends through the remainder of the column and also through the top wall 93 of the box 91. A plate 102 carrying a push button switch 103 is secured to the underside of the top wall 93 by screws 104. The switch 103 has a threaded bushing 105 extending through a cooperating opening in the plate 102 and carries a spring loaded push button 106. A compression spring 107 is retained within the bore 101 and extends upwardly into the bore 100. This spring 107 engages the plate 102 at the bottom end thereof and bears against the bottom surface of the collar 19 of the standard or attachment. The pin 20 of the attachment fits within the spring 107 so that the latter will maintain the attachment in the raised position under all normal conditions of use. The switch 103 is in a normally closed position when the attachment 15 is in the position as shown in FIG. 11. Should the attachment 15 engage an obstacle while the bed is being elevated, the attachment will be depressed whereupon the pin 20 will engage the spring loaded push button 106 and thereby open the switch 103. As will be described, the switch 103, which for convenience is shown as a single pole-single throw switch, functions to interrupt energy to the outlet 98 which is normally energized by means of the cable 108. Details of the circuitry will be described more specifically in connection with FIGS. 16 through 18.

Figure 12:
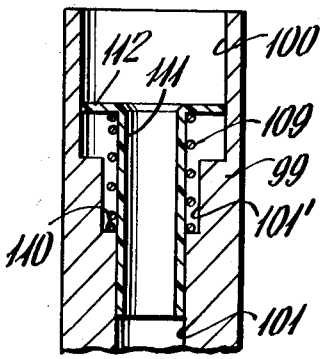
FIG. 12 is a cross sectional view of a fragmentary portion of FIG. 11 showing a modified form of attachment receiving means.

A modified form of attachment supporting means is illustrated in FIG. 12. In this form, the upper portion 101' of the bore 101 is enlarged in diameter to accommodate a spring 109 of somewhat larger diameter than the spring 107. The lower end of the spring 109 bears against the shoulder 110 and a tubular member 111 slidably engages the inside of the spring 109 and the bore portion 101 and includes an outwardly extending flange 112 on the upper end thereof which slidably engages the bore portion 100. The inside diameter of the tubular member 111 is arranged to slidably engage the pin 20 on the bottom of the attachment 15 with the bottom face of the collar 19 engaging the top surface of the flange 112. In this way, engagement of the attachment 15 with the support 90 is greatly facilitated.

Figure 13:
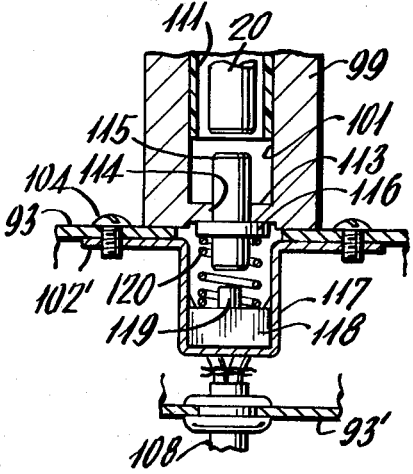
FIG. 13 is a cross sectional view of a fragmentary portion of FIG. 11 illustrating a modified form of switching means.

In certain applications, it may be desirable to locate the switch 103 in a somewhat more protected position and in such cases a structure such as illustrated in FIG. 13 may be employed. In this form of the invention, the bore 101 is terminated at a point spaced from the bottom of the column 99 to leave a wall portion 113. A somewhat smaller opening 114 is formed in the wall 113 to slidably receive a pin 115 having a collar 116 disposed below the wall 113. If desired, a small resilient seal can be placed in the wall of the opening 114 surrounding the pin 115 and which will still permit the pin 115 to be reciprocated within the opening 114. The switch carrying plate denoted by the numeral 102 has a well 117 carrying a switch 118 similar to the switch 103 and having a spring loaded push button 119 for operation thereof. The pin 115 is held in the raised position by a spring 120 bearing against the upper side of the switch 118 and the lower face of the collar 116 forming part of the pin 115. With this arrangement, as the attachment 15 is depressed by engagement of an obstacle, the pin 20 of the attachment will move downwardly with the tubular member 111 as described in connection with FIG. 12, whereupon it will engage the pin 115 which will then be depressed and contact the pushbutton 119 of the switch 118 and thus interrupt energy to the outlet 98 which provides power to operate the bed. In the foregoing embodiments of the invention, push button switches have been utilized in order to interrupt power to the bed elevating means. If desired, a conventional microswitch may also be utilized as illustrated more specifically in FIG. 14. In this form of the invention, a pin 121 slidably engages the bore 101 in column 99 and carries an annular member 122 on the bottom surface thereof. The member 122 has a pair of outwardly extending ears 123 and 124 which engage slots 125 and 126 in the legs 127 and 128 of the U-shaped member generally denoted by the numeral 129. The upper ends of the legs 127 and 128 carry outwardly extending flanges 130 and 131 which are secured to the top wall 93 by means of screws 132. A spring 133 is disposed between the bottom wall of the U-shaped member 129 and the under side of the annular member or disc 122 to hold the pin 121 in the raised position as illustrated. The outer end of the flange 130 has a downwardly extending bracket member 134 carrying a microswitch 135. The microwswitch 135 is positioned relative to the ear 123 so that the latter will engage the operating arm 136 on the microswitch 135 as the pin 121 is depressed. Actuation of the microswitch 135 will interrupt power to the bed as described in connection with the previous embodiments of the invention.

Figure 14:
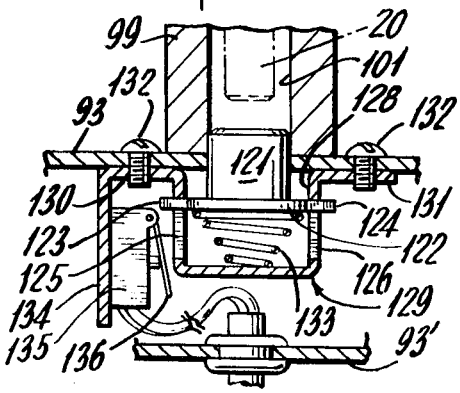
FIG. 14 is a cross sectional view of a fragmentary portion of FIG. 11 illustrating still another form of switching means.
Figure 15:
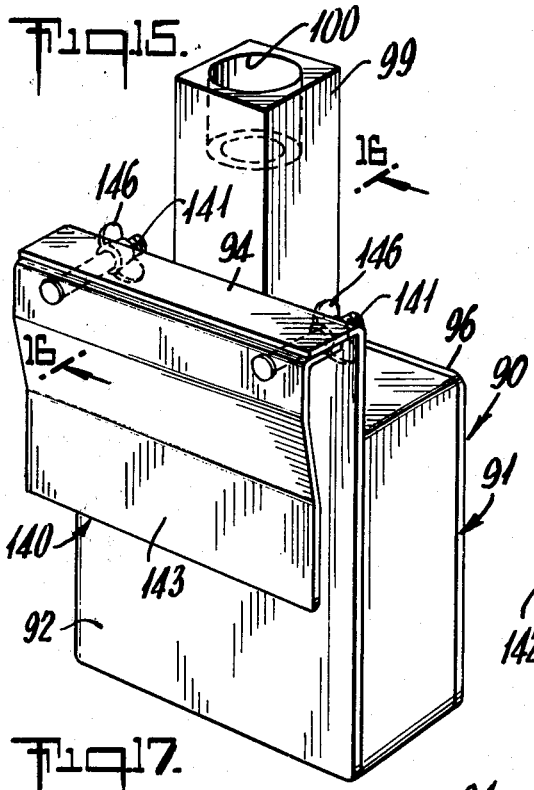
FIG. 15 is a rear perspective view of the structure shown in FIG. 10 illustrating one means for affixing the attachment receiving support to a bed.
Figure 16:
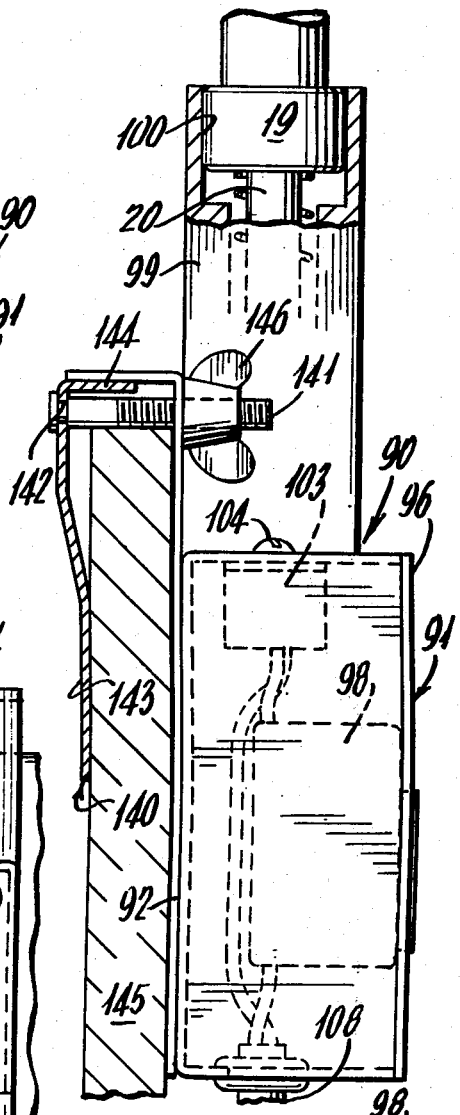
FIG. 16 is a cross sectional view of FIG. 15 taken along the line 16—16 thereof.
Figure 17:
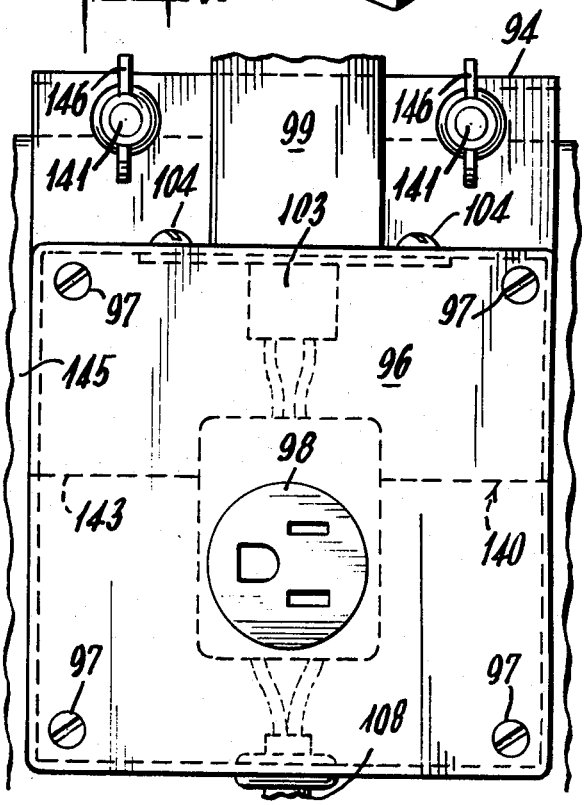
FIG. 17 is a front view of the attachment receiving support shown in FIGS. 15 and 16.

The form of the invention illustrated in FIG. 10 may be fastened directly to a bed as previously described or may be clamped to a frame member of the bed as illustrated for instance in FIGS. 15 through 17. In order to clamp the attachment support 90 to a bed, an L-shaped bracket, generally denoted by the numeral 140, is attached to the support 90 by means of bolts 141 which extend through cooperating openings 142 in the rear wall 143 of the bracket 140. The upper wall 144 of the bracket 140 underlies the rearwardly extending flange 94 and the rear wall 143 of the bracket is tapered inwardly and downwardly to firmly engage a frame member 145 of the bed as illustrated more clearly in FIG. 16. A pair of wing nuts 146 engage the bolts 141 to securely fix the support to the bed frame. As previously pointed out, single pole-single throw switches have been illustrated for simplicity and when using such a switch, one lead from the switch is directly connected to one lead of the cable 108 while the other lead of the cable 108 is connected to one side of the receptacle 98 while the other side of the receptacle 98 is connected to the remaining lead of the switch 103. It is further to be understood that the cable 108 may include a grounding lead connected to the third terminal of the receptacle 98 for grounding purposes and would also be connected to the metal box 90 for the same reason. In actual practice, however, it is preferable to utilize a double pole-single throw switch which when actuated will disconnect both legs of the power cable from the outlet 98. In certain applications, it may also be desirable to utilize an alarm or other suitable signaling means which is activated in the event the attachment such as an infusion standard engages an obstacle on the wall while the bed is being raised. The circuitry for use with the invention as illustrated in FIGS. 10 through 17 is illustrated in schematic form in FIG. 18.

Figure 18:
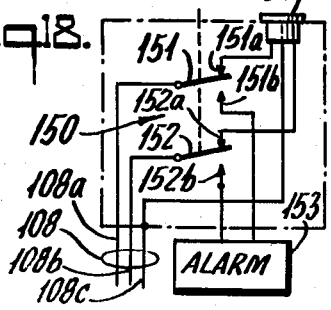
FIG. 18 is one form of a schematic wiring diagram for the form of the invention shown in FIGS. 10 through 17.

As pointed out above, the switches 103, 118 and 135 as shown in FIGS. 11, 13 and 14 were described as single pole-single throw switches for simplicity. A double pole-single throw switch is, however, preferred as it interrupts both of the power supplying leads and in the case where a signal such as an alarm or the like is desired to indicate that the attachment has encountered an obstacle then a double pole-double throw switch may be employed. In FIG. 18, the double pole-double throw switch is generally denoted by the numeral 150 and includes a movable contactor 151 and associated fixed contacts **151*a* and 151*b*. A second movable contactor 152 has two fixed contacts associated therewith and denoted by the numerals 152*a* and 152*b*. Power is fed to the movable contacts 151 and 152 by the leads 108*a* and 108*b* respectively. The lead 108*c* is a ground conductor which would be connected directly to the metal container such as the box 91 and also to the ground terminal on the receptacle 98. Contacts 151***a* and 152*a* are connected directly to the receptacle 98 so that with the switch 150 in the position as illustrated in FIG. 18 power would be normally fed to the outlet 98 which in turn supplies energy to the electrically operated bed elevating means. Should the standard 15 as previously described be depressed by engagement of an obstacle, the movable contactors 151 and 152 would be moved out of engagement with the contacts 151*a* and 152*a* to interrupt energy to the outlet or receptacle 98. At the same time, the movable contactors 151 and 152 will engage the contacts 151*a* and 152*b* and thereby feed energy to the signaling means such as the alarm 153.

While the forms of the invention illustrated in FIGS. 10 through 18 have all utilized mechanically operated switches connected directly in series with the power supplying cable, it is obvious that relay means may be employed as illustrated in FIG. 9.

While only certain embodiments of the invention have been illustrated and described, it is understood that alterations, changes and modifications may be made without departing from the true scope and spirit thereof.

What is claimed is:

1. A protective device for use with an attachment to be carried by a bed having electrically operated elevating means to interrupt elevation of the bed should the attachment encounter an obstacle and wherein said elevating means includes a control switch, comprising switch means interconnected with and overriding said control switch and means resiliently retaining said attachment in a normal raised position, said attachment being movable to a second depressed position upon engagement of an obstacle, said attachment upon movement to said depressed position activating said switch means to override said control switch and interrupt elevation of said bed.

2. A protective device according to claim 1 including an attachment support comprising means for securing it to said bed and means for slidably receiving and supporting an attachment, said resilient means including a spring carried by said support for holding said attachment in a raised position, said switch means being carried by said support and actuated by said attachment upon movement to said second position.

3. A protective device according to claim 2 wherein said support comprises a housing and tubular means carried by said housing and having an upwardly facing attachment receiving opening and said spring being positioned in said opening for engaging said attachment to hold it in said raised position, said switch means being actuated by said attachment upon displacement of said attachment to said second position.

4. A protective device according to claim 3 wherein said tubular means has a large opening in the upper end thereof and a smaller concentric opening communicating with and extending downwardly therefrom, said attachment having a body portion engaging said large opening and a pin extending downwardly from the body portion and engaging said smaller opening, said spring maintaining said body portion in spaced relationship to the bottom of said large opening, the bottom of said large opening limiting downward movement of said attachment to said second position.

5. A protective device according to claim 4 including a second tubular member slidably disposed within said smaller opening and having an outwardly extending peripheral flange disposed within said large opening, said spring surrounding said tubular member and holding it in said raised position, the body of said attachment resting on said peripheral flange with said pin extending into said tubular member.

6. A protective device according to claim 2 wherein said support comprises a housing, tubular means carried by said housing and having an upwardly facing opening, said attachment includes means slidably engaging said tubular means for the support of said attachment in both said first and second positions, said switch means includes a switch actuator and spring means maintaining said switch in a normally closed position whereby movement of said attachment to said second position operates said switch actuator to open said switch.

7. A protective device according to claim 6 wherein said switch is double pole-single throw.

8. A protective device according to claim 6 wherein said switch is double pole-double throw having two movable contactors and two sets of fixed contactors and means normally maintaining said movable contactors in engagement with one set of fixed contacts, and said device includes means for feeding electric power to said movable contacts, connections between said one set of fixed contacts and said electrically operated bed elevating means and signalling means connected to the other set of fixed contacts whereby said attachment upon engaging an obstacle will actuate said switch and shift said movable contactors from said one set of contacts to said other set of contacts interrupting power to said bed elevating means and activating said signalling means.

9. A protective device according to claim 6 wherein said housing includes an electric power receptacle and means for feeding power to said receptacle through said switch means, said receptacle supplying power to said electrically operated bed elevating means.

10. A protective device according to claim 9 wherein said switch means is a microswitch.

* * * * *